US008879243B2

(12) United States Patent
Lee et al.

(10) Patent No.: US 8,879,243 B2
(45) Date of Patent: Nov. 4, 2014

(54) MULTI-DISPLAY DEVICE

(75) Inventors: Sang-Hyeok Lee, Seaongnam-si (KR); Soo-Ran Park, Asan-si (KR); Sang Chul Lee, Yongin-si (KR); Yong-Ju Jeong, Asan-si (KR); Min Sung Choi, Cheonan-si (KR)

(73) Assignee: Samsung Display Co., Ltd. (KR)

( * ) Notice: Subject to any disclaimer, the term of this patent is extended or adjusted under 35 U.S.C. 154(b) by 76 days.

(21) Appl. No.: 13/536,026

(22) Filed: Jun. 28, 2012

(65) Prior Publication Data

US 2013/0188327 A1 Jul. 25, 2013

(30) Foreign Application Priority Data

Jan. 19, 2012 (KR) ..... 10-2012-0006339

(51) Int. Cl.
*G06F 1/16* (2006.01)

(52) U.S. Cl.
USPC ..... 361/679.02; 361/679.04; 361/679.21; 361/679.26; 361/679.22; 361/725

(58) Field of Classification Search
None
See application file for complete search history.

(56) References Cited

U.S. PATENT DOCUMENTS

| | | | | |
|---|---|---|---|---|
| 5,169,693 | A * | 12/1992 | Fujimura | 349/154 |
| 5,299,017 | A * | 3/1994 | Furuno | 348/786 |
| 5,548,350 | A * | 8/1996 | Yamada et al. | 348/839 |
| 5,995,179 | A * | 11/1999 | Tamura et al. | 349/58 |
| 6,337,727 | B1 * | 1/2002 | Ono et al. | 349/153 |
| 6,519,085 | B2 * | 2/2003 | Brandt | 359/449 |
| 7,576,976 | B2 | 8/2009 | Kawano | |
| 7,852,424 | B2 | 12/2010 | Sugawara | |
| 7,965,039 | B2 | 6/2011 | Watanabe et al. | |
| 2002/0003591 | A1 * | 1/2002 | Giannatto | 349/58 |
| 2003/0117053 | A1 * | 6/2003 | Tajima | 313/292 |
| 2003/0133037 | A1 * | 7/2003 | Lee | 348/383 |
| 2004/0008512 | A1 * | 1/2004 | Kim | 362/235 |
| 2005/0140912 | A1 * | 6/2005 | Hirakata et al. | 349/153 |
| 2005/0168954 | A1 * | 8/2005 | Kim | 361/725 |
| 2008/0143918 | A1 * | 6/2008 | Kim | 349/58 |
| 2009/0033826 | A1 | 2/2009 | Shimizu | |
| 2009/0225506 | A1 * | 9/2009 | Lee et al. | 361/679.21 |
| 2010/0103641 | A1 | 4/2010 | Cho et al. | |
| 2010/0142128 | A1 * | 6/2010 | Takechi | 361/679.01 |
| 2011/0018823 | A1 | 1/2011 | Moon | |
| 2011/0038112 | A1 | 2/2011 | Shintani et al. | |

FOREIGN PATENT DOCUMENTS

| | | | |
|---|---|---|---|
| JP | 2006235082 | A | 9/2006 |
| JP | 2011027879 | A | 2/2011 |
| KR | 1020080071637 | A | 8/2008 |
| KR | 1020100127446 | A | 12/2010 |
| KR | 10-1009645 | A | 1/2011 |
| KR | 10201 10087051 | A | 8/2011 |

* cited by examiner

*Primary Examiner* — Tuan T Dinh
*Assistant Examiner* — Steven T Sawyer
(74) *Attorney, Agent, or Firm* — Cantor Colburn LLP

(57) ABSTRACT

A multi-display device includes a plurality of display devices. A display device of the plurality of display devices includes: a display panel including a front side, a rear side, first and second sides which face each other, and third and fourth sides which face each other; a first chassis which is fixed to the first side; a second chassis which is fixed to the second side; a third chassis which is fixed to the third side; a fourth chassis which is fixed to the fourth side; and a fixing member between one or more of the first to fourth chassis, and the display panel. The fixing member fixes the one or more of the first to fourth chassis, to the display panel. The fixing member is provided at a boundary between adjacent display devices of the plurality of display devices.

18 Claims, 15 Drawing Sheets

MULTI-DISPLAY DEVICE

This application claims priority to Korean Patent Application No. 10-2012-0006339 filed on Jan. 19, 2012, and all the benefits accruing therefrom under 35 U.S.C. §119, the entire contents of which are incorporated herein by reference.

BACKGROUND (a) Field

The invention relates to a multi-display device. More particularly, the invention relates to a multi-display device that can minimize a bezel.

(b) Description of the Related Art

In general, a thin film transistor ("TFT") is used as a switching element for independently driving each pixel in a flat panel display such as a liquid crystal display or an organic light emitting diode display. A thin film transistor array panel of the flat panel display includes the thin film transistor, a pixel electrode that is connected thereto, a gate line that transmits a gate signal to the thin film transistor and a data line that transmits a data signal.

The thin film transistor is formed of a gate electrode that is connected to the gate line, a source electrode that is connected to the data line, a drain electrode that is connected to the pixel electrode, and a semiconductor layer that is disposed on the gate electrode, and respectively between gate electrode and the source electrode and drain electrode. The data signal is transmitted to the pixel electrode from the data line according to the gate signal from the gate line.

The thin film transistor array panel is bonded with an opposing array panel of the flat panel display such that one display panel is formed. The display panel is fixed by being surrounded by a chassis that can protect and receive the display panel such that one display device is formed.

In this case, the chassis for fixing the one display panel includes a bottom chassis formed to cover the rear side of the one display panel and a top chassis fixed to the bottom chassis to surround the front edge of the one display panel.

Recently, research and development on a transparent display device has been actively conducted, and a front side and a rear side of the transparent display device can both display an image. When a bottom chassis covering the entire rear side of the display panel is used in the transparent display device, an image cannot be displayed by the rear side of the display panel because the rear side is wholly shielded. Further, when the bottom chassis is not used, the display panel cannot be properly fixed and protected in the display device.

A portion of the display device that is shielded by the chassis so that no image can be displayed is called a bezel, and research and development on the bezel has been actively conducted. In particular, in case of a multi-display device formed by connecting several display devices to display one screen, an accurate image cannot be displayed in a boundary between the display devices due to the bezel.

SUMMARY

The invention has been made in an effort to provide a multi-display device including a plurality of display devices that properly fixes and protects a display panel in a display device, while minimizing shielded portions of front and rear sides of the display panel.

In addition, the invention provides a multi-display device that displays an accurate image at a boundary of each display device.

An exemplary embodiment of a multi-display device includes a plurality of display devices. A display device of the plurality of display devices includes: a display panel including a front side, a rear side, first and second sides which faces each other, and third and fourth sides which face each other; a first chassis which is fixed to the first side; a second chassis which is fixed to the second side; a third chassis which is fixed to the third side; a fourth chassis which is fixed to the fourth side; and a fixing member between one or more of the first to fourth chassis, and the display panel, where the fixing member fixes the one or more of the first to fourth chassis, to the display panel. The fixing member is at a boundary between adjacent display devices of the plurality of display devices.

The first chassis and the second chassis may be symmetrical to each other.

The first chassis may include a first front portion which overlaps an edge of the front side adjacent to the first side of the display panel, and a first side portion which is connected with the first front portion and covers the first side.

The fixing member may be between the first front portion and the display panel.

The first chassis may include a first protruding portion which protrudes from a first end of the first front portion, and a first coupling member which penetrates the first protruding portion and has a screw thread therein.

The first chassis may further include a second protruding portion which is connected with the first front portion and the first side portion at a second end of the first front portion, and overlaps a portion of the third side which is adjacent to the first side.

The first chassis may further include a third protruding portion which protrudes in the same direction as the first protruding portion and from the second end of the first front portion.

The first chassis may further include a first rear portion which is connected with the first side portion and overlaps an edge of the rear side adjacent to the first side of the display panel, and the fixing member may be between the first rear portion and the display panel.

The third chassis may include a second front portion which overlaps an edge of the front side adjacent to the third side of the display panel, and a second side portion which is connected with the second front portion and covers the third side.

The fixing member may be between the second front portion and the display panel.

The third chassis may further include a second rear portion which is connected with the second side portion and covers an edge of the rear side adjacent to the third side of the display panel, and the fixing member may be between the second rear portion and the display panel.

The multi-display device may further include a printed circuit board which is attached to the fourth side of the display panel and transmits signals for driving the display panel. The fourth side may not be adjacent to an adjacent display device of the plurality of display devices.

The fourth chassis may include a first portion which is fixed to the first chassis and the second chassis, and a second portion which covers the first portion and is fixed to the first portion.

The first portion may further include a second coupling member at opposing ends of the first portion, where the second coupling member penetrates the first portion and has a screw thread therein.

The multi-display device may further include a first connecting member which overlaps the first chassis and the fourth chassis, and the first connecting member may further include a first hole which penetrates the first connecting member.

The multi-display device may further include a plurality of first fastening members which connect the first connecting member and the first chassis to each other, and connect the first connecting member and the fourth chassis to each other. The first chassis may include a first protruding portion which protrudes from a first end of the first front portion, and a first coupling member which penetrates the first protruding portion and has a screw thread therein. The first fastening member may be in the first coupling member and in the second coupling member, and extend through the first hole.

The first portion may further include a protruding coupling member which protrudes from the first portion and has a screw thread therein.

The second portion may further include a second hole which penetrates the second portion.

The multi-display device may further include a second fastening member which is in the protruding coupling member and extends through the second hole.

The display device may be a transparent display device.

One or more exemplary embodiments of the multi-display device has the following effects.

One or more exemplary embodiments of the multi-display device uses a thin or small-dimension fixing member such as double-sided adhesive tape to fix a chassis and a display panel to each other at a portion where a plurality of display devices are adjacent to each other, so that a size of a portion of the display panel shielded by the chassis can be minimized.

In addition, the chassis and the display panel can be fixed to each other using the thin or small-dimension fixing member, and the first chassis includes the first protruding portion such that the first protruding portion of the first chassis and the fourth chassis are fixed to each other using a connecting member so that the display panel may be firmly fixed within the display device and protected.

Further, a size of the bezel can be minimized so that an accurate image can be displayed at a boundary between adjacent display devices of the multi-display device.

BRIEF DESCRIPTION OF THE DRAWINGS

The above and other advantages and features of this disclosure will become more apparent by describing in further detail exemplary embodiments thereof with reference to the accompanying drawings, in which.

DETAILED DESCRIPTION

Figure 1:
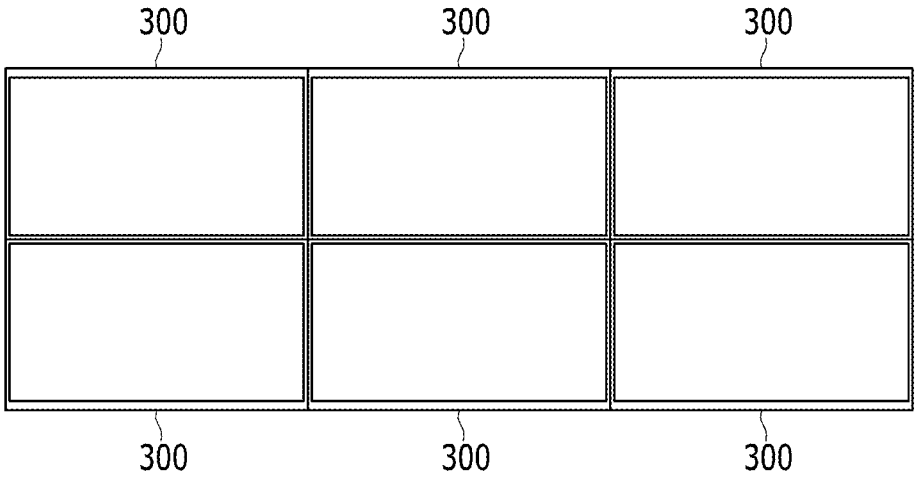
FIG. 1 is a schematic top plan view of an exemplary embodiment of a multi-display device according to the invention.

The invention will be described more fully hereinafter with reference to the accompanying drawings, in which exemplary embodiments of the invention are shown. As those skilled in the art would realize, the described embodiments may be modified in various different ways, all without departing from the spirit or scope of the invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the invention.

Spatially relative terms, such as "lower," "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

First, an exemplary embodiment of a multi-display device according to the invention will be described with reference to the accompanying drawings.

FIG. 1 is a schematic top plan view of an exemplary embodiment of a multi-display device according to the invention.

As shown in FIG. 1, an exemplary embodiment of a multi-display device according to the invention includes a plurality of display devices 300 arranged in a matrix format. Three display devices 300 are disposed in a horizontal direction and two display devices 300 are disposed in a vertical direction such that six display devices 300 form one multi-display device. The arrangement of the multi-display device is one example, and thus various numbers of display devices 300 can be arranged in a various formats.

In this case, the display device 300 disposed first from the left and first from the top is arranged to be adjacent to other display devices 300 at the right edge and the bottom edge among four edges thereof. The display device 300 disposed second from the left and first from the top is arranged to be adjacent to other display devices 300 at the left edge, the right edge, and the bottom edge among four edges thereof. The display device 300 disposed third from the left and first from the top is arranged to be adjacent to other display devices at the left edge and the bottom edge among four edges thereof.

In addition, the display device 300 disposed first from the left and second from the top is adjacent to other display devices 300 at the right edge and the top edge among four edges thereof. The display device 300 disposed second from the left and second from the top is adjacent to other display devices 300 at the left edge, the right edge and the top edge among four edges thereof. The display device 300 disposed third from the left and second from the top is adjacent to other display devices 300 at the left edge and the top edge among four edges thereof.

That is, the display devices 300 collectively forming one multi-display device have edges that are respectively adjacent to other display devices 300.

The display devices 300 forming the multi-display device will now be described in further detail.

Figure 2:
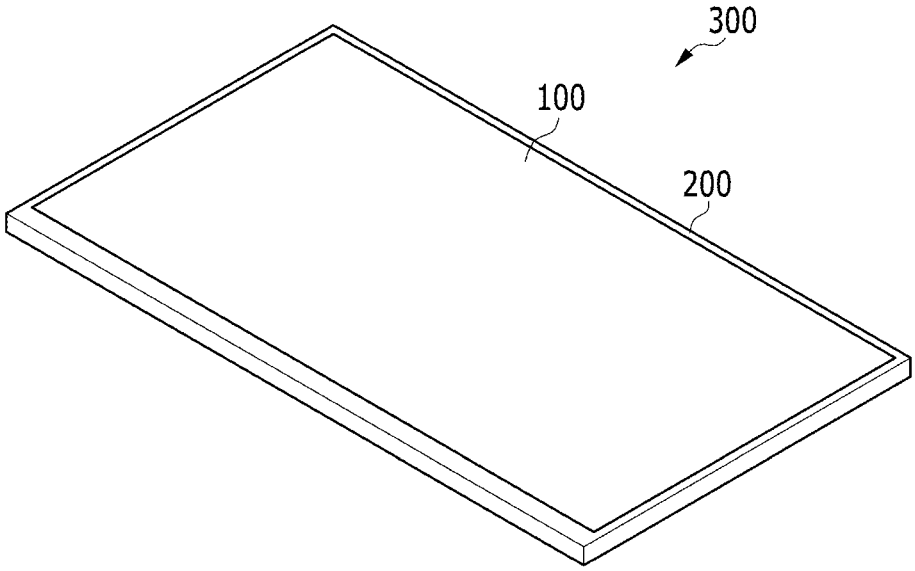
FIG. 2 is a perspective view of an exemplary embodiment of one display device of the multi-display device of FIG. 1 according to the invention.
Figure 3:
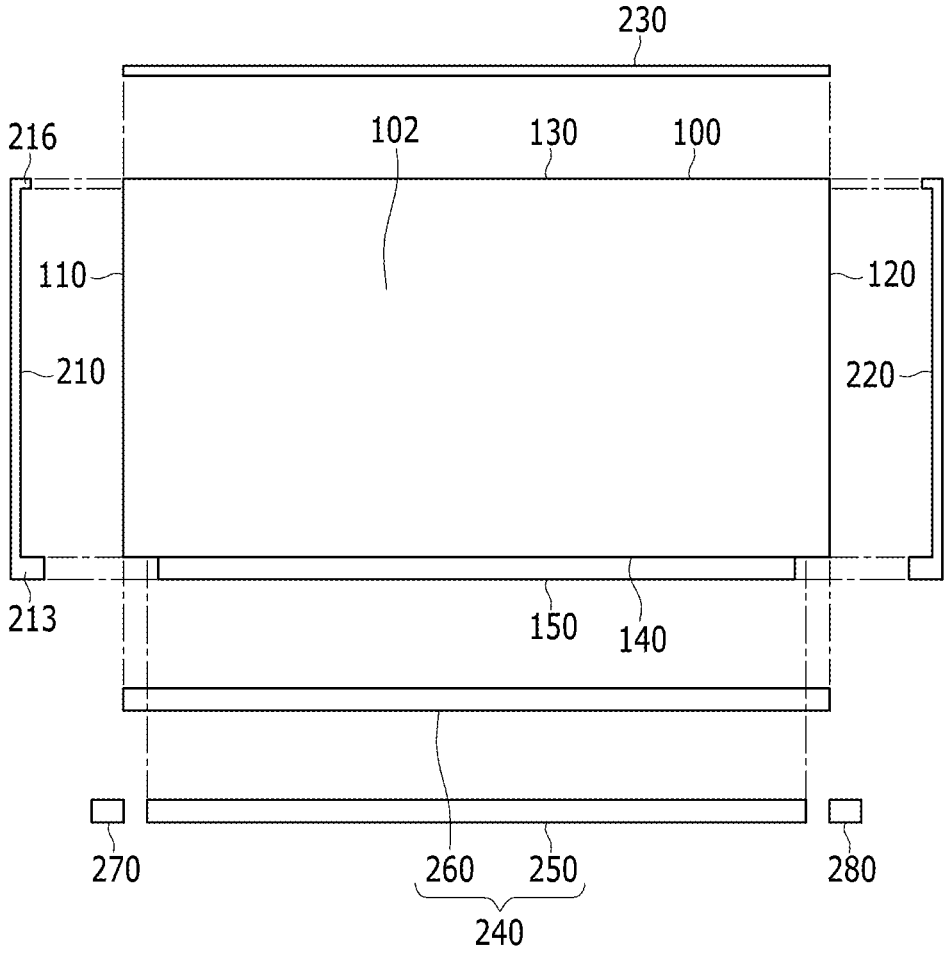
FIG. 3 is a top plan exploded view illustrating the display device of FIG. 2 according to the invention.

FIG. 2 is a perspective view of an exemplary embodiment of one display device of the multi-display device of FIG. 1, and FIG. 3 is a top plan exploded view of the display device of FIG. 2 according to the invention.

As shown in FIG. 2, one of the display devices 300 which forms the multi-display device includes a display panel 100 displaying an image and a chassis 200 surrounding the four edges of the display panel 100.

The display panel 100 may be a liquid crystal panel including two substrates that are attached to each other while facing each other with a liquid crystal layer therebetween. Alternatively, the display panel 100 may be an organic light emitting device, an electrophoretic display, and the like.

As shown in FIG. 3, the display panel 100 includes a front side 102, a rear side opposite to the front side 102 (not shown), and first to fourth sides 110, 120, 130 and 140 respectively connected with the front side 102 and the rear side. An image is display on one of the front side 102 and the rear side, or on both the front side 102 and the rear side. The display panel 100 may be a transparent display device of which both of the front side 102 and the rear side display an image. The sides of the display panel 100 include the first side 110, the second side 120, the third side 130 and the fourth side 140. The first side 110 and the second side 120 face each other, and the third side 130 and the fourth side 140 face each other.

In the exemplary embodiment, a printed circuit board ("PCB") 150 may be attached to one or more of the first to fourth sides 110, 120, 130 and 140 of the display panel 100. The PCB 150 can transmit signals for driving the display panel 100, and FIG. 3 illustrates that the PCB 150 is attached to the fourth side 140 of the display panel 100. The PCB 150 can be at any side of the display panel 100. The PCB 150 has a length along a longitudinal axis of the PCB 150 and a width taken perpendicular to the length, such as being perpendicular to the fourth side 140 of the display panel 100.

In the case when the display panel 100 is a transparent display device, both of the front side 102 and the rear side of the display panel 100 can display an image, and therefore when the PCB 150 is folded or bent and then disposed at the rear side of the display panel 100, a portion of the rear side of the display panel 100 which is shielded by the PCB 150 cannot display an image. Thus, the PCB 150 is attached to any one of the first to fourth sides 110, 120, 130 and 140 of the display panel 100 such that the PCB 150 is plane-shaped on both the front side 102 and the rear side of the display panel 100.

The chassis 200 includes a first chassis 210 fixed to the first side 110 of the display panel 100, a second chassis 220 fixed to the second side 120 of the display panel 100, a third chassis 230 fixed to the third side 130 of the display panel 100, and a fourth chassis 240 fixed to the fourth side 140 of the display panel 100. The first chassis 210 and the second chassis 220 may be symmetrical to each other. Longitudinal axes of the first to fourth chasses 210, 220, 230 and 240 extend substantially parallel to the first to fourth sides 110, 120, 130 and 140 of the display panel 100, respectively.

The first chassis 210 covers the first side of the display panel 100 and edges of the front side 102, adjacent to the first side 110. A first end of the first chassis 210 may protrude further than an edge of the front side 102 as illustrated at the fourth side 140 in FIG. 2. Alternatively, first and second end of the first chassis 210 may protrude further than opposing edges of the front side 102, for example, at the third and fourth sides 130 and 140 of the display panel 100.

The second chassis 220 covers the second side 120 of the display panel 100 and edges of the front side 102, adjacent to the second side 120. One of more of the first and second ends of the second chassis 220 may protrude further than an edge of the front side 102.

The third chassis 230 covers the third side 130 of the display panel 100 and edges of the front side 102, adjacent to the third side 130.

The fourth chassis 240 covers the fourth side 140 of the display panel 100 and edges of the front side 102, adjacent to the fourth side 140. The fourth chassis 240 includes a first portion 250 fixed to both the first and second chassis 210 and 220, and a second portion 260 covering the first portion 250 and fixed to the first portion 250. The first portion 250 and the second portion 260 may be substantially parallel with each other. The first portion 250 and the second portion 260 of the fourth chassis 240 are disposed at opposing surfaces of the PCB 150. In one exemplary embodiment, for example, the first portion 250 may be disposed in front of the PCB 150 on an upper surface thereof, and the second portion 260 may be disposed in back of the PCB 150 on a lower surface at the rear thereof. Alternatively, the first portion 250 may be disposed at the rear of the PCB 150 and the second portion 260 may be disposed at the front of the PCB 150.

Further, the display device 300 may include a first connecting member 270 between the first chassis 210 and the first portion 250 of the fourth chassis 240, and a second connecting member 280 between the second chassis 220 and the first portion 250 of the fourth chassis 240.

Next, an exemplary embodiment of a structure of the chassis of the multi-display device according to the invention will be described in further detail.

First, referring to FIG. 4 and FIG. 5, the first chassis and the second chassis of the multi-display device according to the invention will be described. The second chassis is symmetrical to the first chassis, and therefore no further described will be provided.

Figure 4:
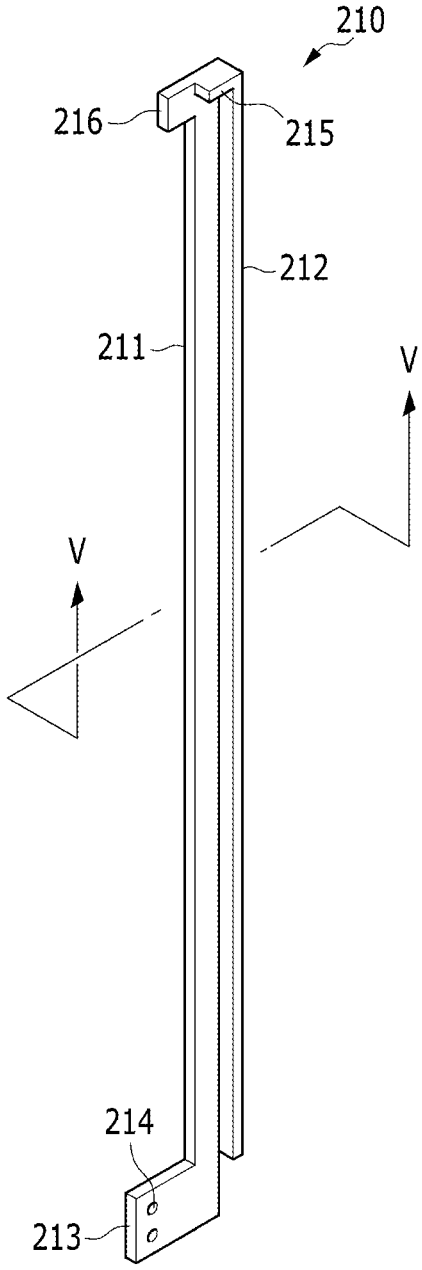
FIG. 4 is a perspective view of an exemplary embodiment of a first chassis of the multi-display device according to the invention.
Figure 5:
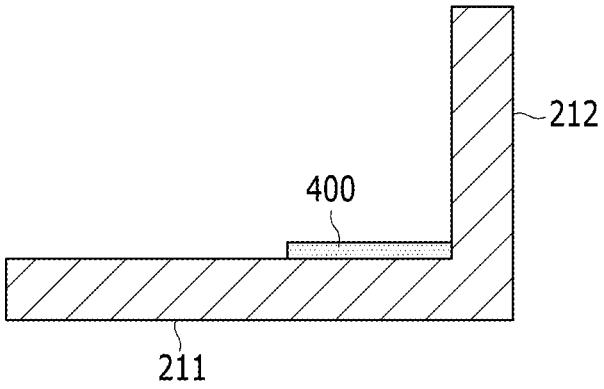
FIG. 5 is a cross-sectional view of the first chassis taken along line V-V of FIG. 4 and a fixing member attached thereto according to the invention.

FIG. 4 is a perspective view of an exemplary embodiment of a first chassis of the multi-display device according to the invention, and FIG. 5 is a cross-sectional view of the first chassis taken along line V-V of FIG. 4 and a fixing member attached thereto according to the invention.

The first chassis 210 includes a relatively long and even bar-shaped first front portion 211 and a relatively long and even bar-shaped first side portion 212. The first side portion 212 is connected with the first front portion 211, such that the first chassis 210 may be a single, unitary, indivisible member.

The first front portion 211 may have a length corresponding to that of the first side 110 of the display panel 100 or may be longer than the first side 110. A fixing member 400, such as a double-sided adhesive tape, is attached to an inner side of the first front portion 211. The first front portion 211 of the first chassis 210 is arranged to face, overlap and cover edges of the front side 102 of the display panel 100 adjacent to the first side 110. The first side portion 212 is arranged to face, overlap and cover the first side 110 of the display panel 100. The first chassis 210 is fixed to the first side 110 of the display panel 100 using the double-sided adhesive tape 400. When display devices 300 are disposed adjacent to each other, the double-sided adhesive tape 400 at the inner side of the first front portion 211 is at a boundary between the adjacent display devices 300. The fixing member 400 is completely between the first front portion 211 of the first chassis 210 and the front side 102 of the display panel 100.

Since edges of the front side 102 of the display panel 100 is shielded by the first front portion 211 of the first chassis 210, a width of the first front portion 211 can determine the size of a bezel of the display device 300. The width may be taken perpendicular to the first side 110 of the display panel 100. Accordingly, a size of the bezel can be reduced as the width of the first front portion 211 is reduced. However, when the width of the first front portion 211 is too small, adherence between the first chassis 210 and the display panel 100 is weakened, and therefore the first front portion 211 has a width that can properly fix the first chassis 210 to the display panel 100.

The first side portion 212 is bent about 90 degrees with respect to the first front portion 211, and may have a length that corresponds to the length of the first side 110 of the display panel 100. The first side portion 212 is arranged to cover the first side 110 of the display panel 100 and protect the edges of the display panel 100.

The first chassis 210 may further include a first protruding portion 213 protruding from a first end of the first front portion 211. The first protruding portion 213 is in a same plane as the first front portion 211. The first protruding portion 213 may be bent about 90 degrees from the first end of the first front portion 211. The first protruding portion 213 may be disposed by the fourth side 140 of the display panel 100. The first protruding portion 213 of the first chassis 210 may further include a first coupling member 214. The first coupling member 214 may include a female threaded hole penetrating into the first protruding portion 213 and having a screw thread therein.

The first chassis 210 may further include a second protruding portion 215 protruding from a second end of the first front portion 211. The second protruding portion 215 is bent about 90 degrees from the second ends of the first front portion 211 and from the first side portion 212 to connect the first front portion 211 and the first side portion 212 to each other. The second protruding portion 215 may protect the edges of the display panel 100 by covering a portion of the third side 130 directly adjacent to and connected with the first side 110 of the display panel 100.

The first chassis 210 may further include a third protruding portion 216 protruding from the second end of the first front portion 211. The third protruding portion 216 is in a same plane as the first front portion 211. The third protruding portion 216 may be bent about 90 degrees from the second end of the first front portion 211, and may protrude in the same direction as the first protruding portion 213. The third protruding portion 216 may be arranged to partially cover the edge of the front side 102, directly adjacent to the first side 110 and the third side 130 of the display panel 100.

The second chassis 220 is symmetrical to the first chassis 210, and covers the second side 120 of the display panel 100 and the edge of the front side 102, adjacent to the second side 120. A fixing member 400 such as a double-sided adhesive tape is between the second chassis 220 and the display panel 100 to fix the second chassis 220 to the second side 120 of the display panel 100 and to protect the edge of the display panel 100.

The third chassis of the multi-display device according to the invention will now be described with reference to FIG. 6 and FIG. 7.

Figure 6:
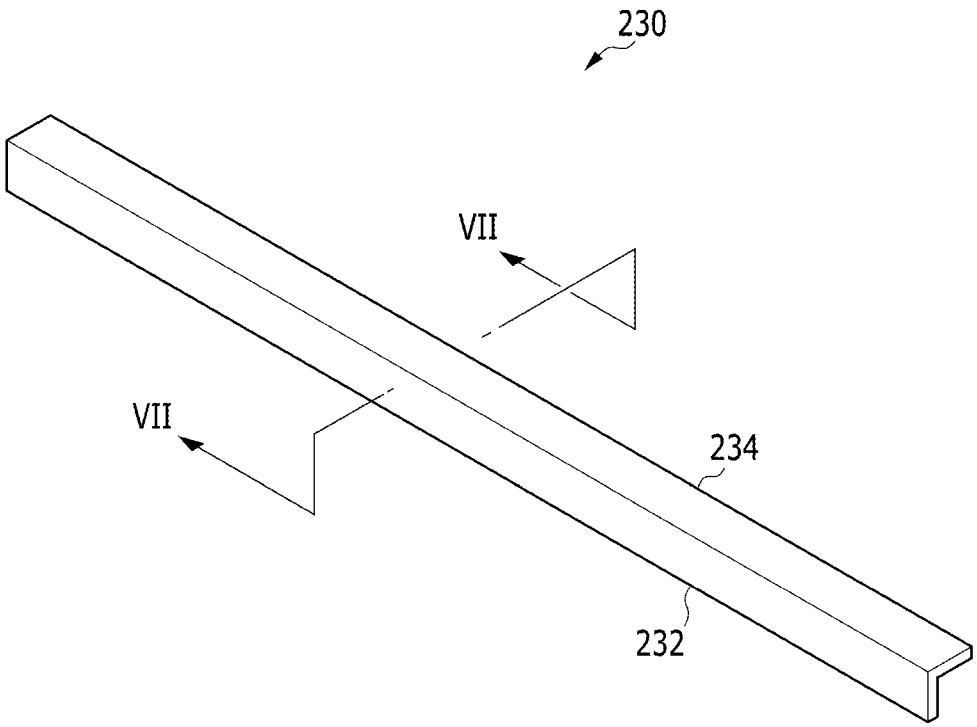
FIG. 6 is a perspective view of an exemplary embodiment of a third chassis of the multi-display device according to the invention.
Figure 7:
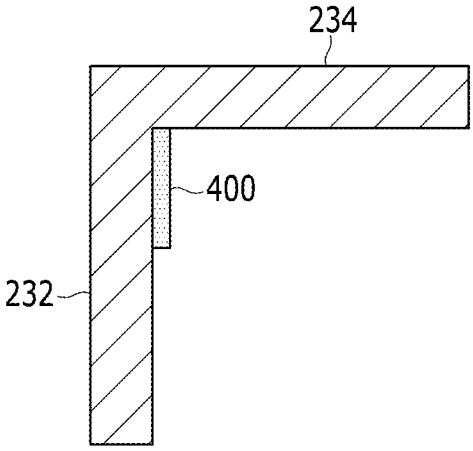
FIG. 7 is a cross-sectional view of the third chassis taken along line VII-VII of FIG. 6 and a fixing member attached thereto according to the invention.

FIG. 6 is a perspective view of an exemplary embodiment of a third chassis of the multi-display device according to the invention, and FIG. 7 is a cross-sectional view of the third chassis taken along line VII-VII of FIG. 6 and a fixing member attached thereto according to the invention.

The third chassis 230 includes a relatively long and even bar-shaped second front portion 232 and a relatively long and even bar-shaped second side portion 234. The second side portion 234 is connected with the second front portion 232, such that the third chassis 230 may be a single, unitary, indivisible member.

The length of second front portion 232 may equivalent to or shorter than the length of the third side 130 of the display panel 100. A fixing member 400, such as a double-sided adhesive tape, is attached to an inner side of the second front portion 232. The second front portion 232 of the third chassis 230 is arranged to face, overlap and cover the edge of the front side 102, adjacent to the third side 130 of the display panel 100. The second side portion 234 is arranged to face, overlap and over the third side 130 of the display panel 100. The third chassis 230 is fixed to the third side 130 of the display panel 100 using the double-sided adhesive tape 400. When display devices 300 are disposed adjacent to each other, the double-sided adhesive tape 400 at the inner side of the second front portion 232 is at a boundary between the adjacent display devices 300. The fixing member 400 is completely between the second front portion 232 of the third chassis 230 and the front side 102 of the display panel 100.

Since edges of the front side 102 of the display panel 100 is shielded by the second front portion 232 of the third chassis 230, a width of the second front portion 232 can determine the size of the bezel of the display device 300. The width may be taken perpendicular to the third side 130 of the display panel 100. Accordingly, the size of the bezel can be reduced as the width of the second front portion 232 is reduced. However, when the width of the second front portion 232 is too small, adherence between the third chassis 230 and the display panel 100 is weakened, and therefore the second front portion 232 has a width that can properly fix the third chassis 230 to the display panel 100.

The second side portion 234 is bent about 90 degrees with respect to the second front portion 232, and may have a length that is equivalent to or shorter than the length of the third side 130 of the display panel 100. The second side portion 234 is arranged to cover the third side 130 of the display panel 100 and protect the edges of the display panel 100.

When the third chassis 230 is fixed to the display panel 100, the second front portion 232 of the third chassis 230 may be partially overlapped with the third protruding portion 216 of the first chassis 210. In addition, the second side portion 234 of the third chassis 230 may be partially overlapped with the second protruding portion 215 of the first chassis 210. The second front portion 232 of the third chassis 230 may be partially overlapped with the third protruding portion 216 of the second chassis 220

First and second portions of the fourth chassis of the multi-display device according to the invention will now be described with reference to FIG. 8 and FIG. 9.

Figure 8:
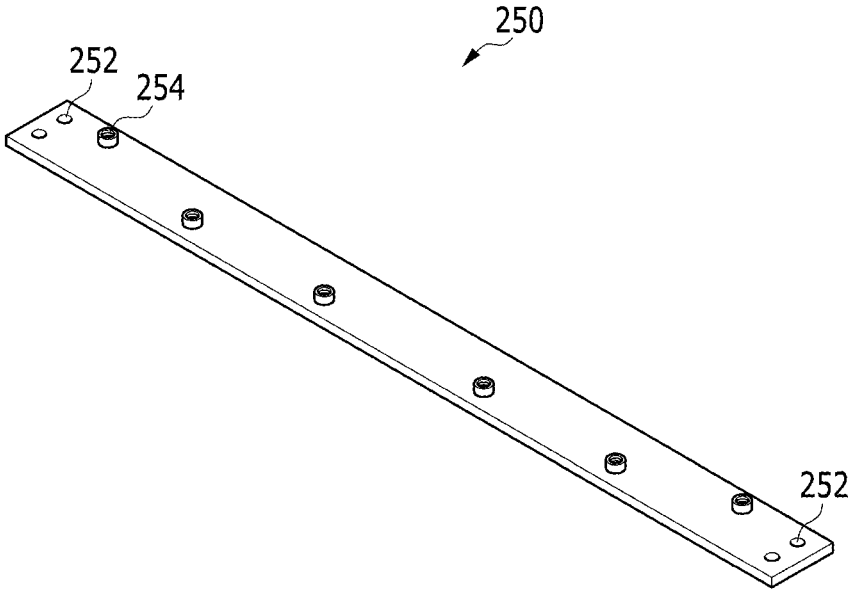
FIG. 8 is a perspective view of an exemplary embodiment of a fourth chassis of the multi-display device according to the invention.
Figure 9:
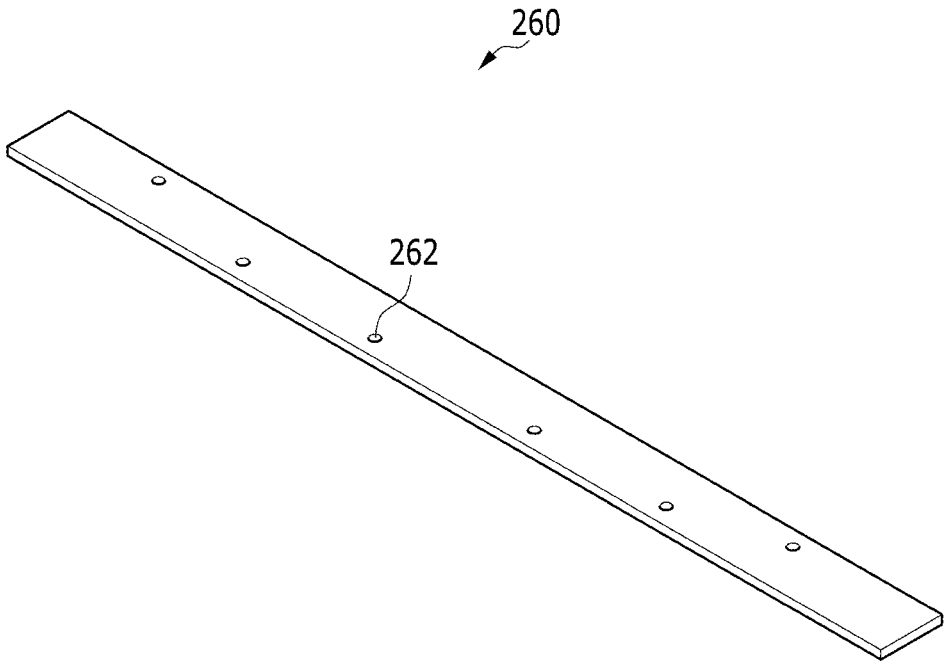
FIG. 9 is a perspective view of an exemplary embodiment of a second portion of the fourth chassis of the multi-display device according to the invention.

FIG. 8 is a perspective view of an exemplary embodiment of a first portion of the fourth chassis of the multi-display device according to the invention, and FIG. 9 is a perspective view of an exemplary embodiment of a second portion of the fourth chassis of the multi-display device according to the invention.

As shown in FIG. 8, the first portion 250 has a length taken along a longitudinal axis of the first portion 250 and a width taken perpendicular to the length. The first portion 250 of the fourth chassis 240 may have a width corresponding to or larger than the width of the PCB 150. The first portion 250 is arranged in front of the PCB 150 on an upper surface thereof to prevent the PCB 150 from being viewed from outside the display device 300.

The first portion 250 may include a second coupling member 252 at each of opposing ends of the first portion 250. The second coupling member 252 may include a female threaded hole have a screw thread therein. FIG. 8 illustrates that two second coupling members 252 are in a left end of the first portion 250 and two second female thread members 252 are in a right end of the first portion 250, but the number of and/or the position of the second coupling members 252 can be variously modified.

The first portion 250 may further include protruding coupling members 254 protruding from the first portion 250. The protruding coupling member 254 may include a female threaded protrusion and have a screw thread therein. Each of the protruding coupling members 254 protrudes from the first portion 250 by a predetermined distance, and the distance at which the protruding coupling member 254 protrudes may correspond to a thickness of the PCB 150. The thickness is taken perpendicular to the front side 102 or the rear side of the display device 300. Referring to FIG. 8, the PCB 150 may be disposed overlapping an area the planar portion of the first portion 250 of the fourth chassis 240, where the area is located between the two protruding coupling member 254 at opposing ends of the first portion 250 and adjacent to the four protruding coupling member 254.

As shown in FIG. 9, a second portion 260 of the fourth chassis 240 may have the same width as the first portion 250, and the length of the first portion 250 may correspond to the length of the fourth side 140 of the display panel 100. The second portion 260 may be disposed in back of the PCB 150 on a lower surface thereof to prevent the PCB 150 from being viewed from the outside.

The second portion 260 may include second holes 262 penetrating into the second portion 260. The second holes 262 may be disposed at positions corresponding to the protruding coupling members 254 of the first portion 250. The protruding coupling members 254 and the second holes 262 are engaged with each other when the second portion 260 is coupled with the first portion 250. In addition, the number of second holes 262 may correspond to the number of protruding coupling members 254. Referring to FIG. 9, the PCB 150 may be disposed overlapping an area the planar portion of the second portion 260 of the fourth chassis 240, where the area is located between the two holes 262 at opposing ends of the first portion 250 and adjacent to the four holes 262.

Figure 10:
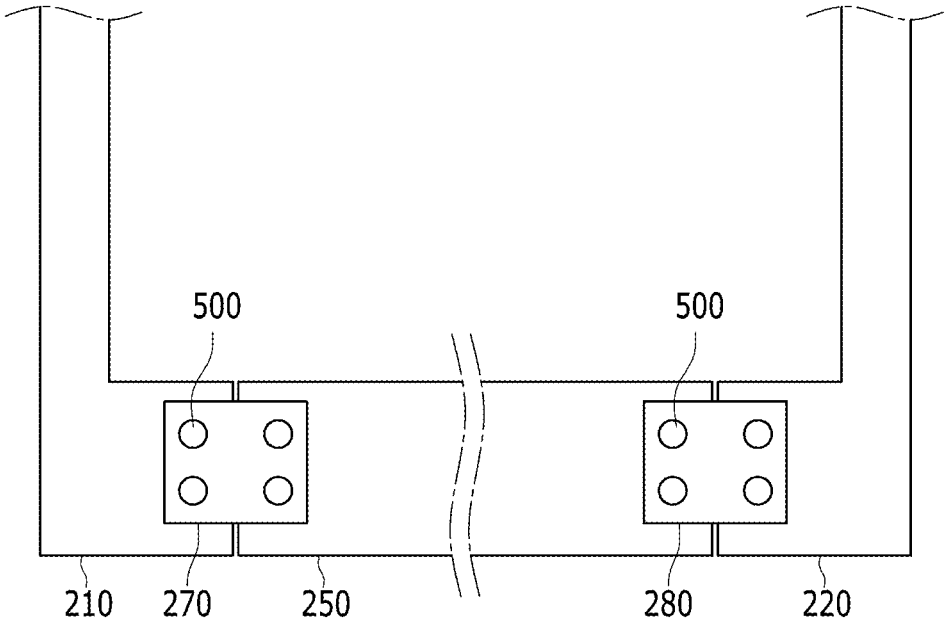
FIG. 10 is a perspective view of an exemplary embodiment of a portion in a first portion of the fourth chassis, to which the first chassis and the second chassis are connected, of the multi-display device according to the invention.
Figure 11:
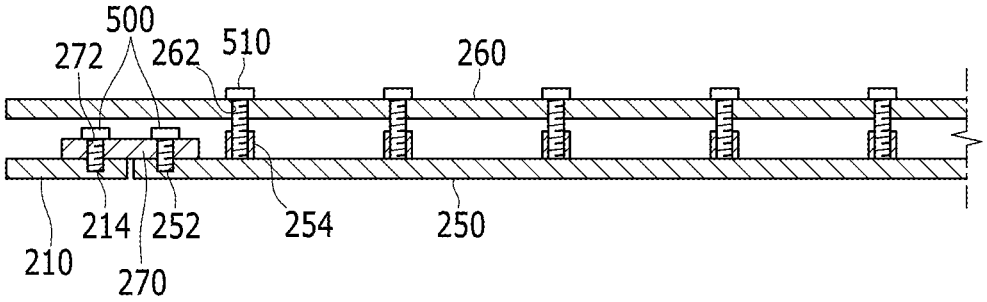
FIG. 11 is a cross-sectional view of an exemplary embodiment of a portion where the first and second chassis of the multi-display device are connected to the first portion of the fourth chassis, and a portion where the first portion and the second portion of the fourth chassis are connected each other according to the invention.

Referring to FIG. 10 and FIG. 11, an exemplary embodiment of a manner of coupling the first portion of the fourth chassis of the multi-display device to the first and second chassis, and a manner of coupling the second portion of the fourth chassis to the first portion of the fourth chassis will be described.

FIG. 10 is a perspective view of a portion of the multi-display device where the first and second chassis are coupled to the first portion of the fourth chassis, and FIG. 11 is a cross-sectional view of a portion of the multi-display device where the first chassis is coupled to the first portion of the fourth chassis and where the first portion and the second portion of the fourth chassis are coupled with each other.

The first connecting member 270 and the second connecting member 280 that connect the first portion 250 of the fourth chassis 240 to the first chassis 210 and to the second chassis 220 may be quadrangle-shaped such as in the plan and/or cross-sectional view. The second connecting member 280 may be shaped the same as the first connecting member 270. The structure of coupling the fourth chassis 240 and the first chassis 210, and a structure of coupling the fourth chassis 240 and the second chassis 220 may be equivalent to each other. Thus, the coupling structure of the fourth chassis 240, the second chassis 220 and the second connecting member 280 will not be further described.

The first connecting member 270 includes a first hole 272 through which a connecting member is penetrated. Two first holes 272 may be provided in a first end of the first connecting member 270 and two first holes 272 may be provided in a second end opposite to the first end of the first connecting member 270. The positions and the number of the first holes 272 may be variously modified.

The first protruding portion 213 of the first chassis 210 and the first portion 250 of the fourth chassis 240 are arranged to be located in the same plane, and the first connecting member 270 is arranged to be overlapped with the first protruding portion 213 of the first chassis 210 and the first portion 250 of the fourth chassis 240. In this case, the first coupling members 214 in the first protruding portion 213 may be aligned with the first holes 272 in the first end of the first connecting member 270. In addition, the second coupling members 252 in the first end of the first portion 250 may be aligned with the first holes 272 in the second end of the first connecting member 270.

In order to fix the first connecting member 270 to the first chassis 210 and the fourth chassis 240, first fastening members 500 may be further provided. The first fastening members 500 may be male threaded member having a screw thread at the external side thereof. The first fastening members 500 may engage with the first coupling members 214 and the second coupling members 252 through the first holes 272, to fasten the first chassis 210 to the fourth chassis 240.

While the first portion 250 of the fourth chassis 240 is fixed to the first and second chassis 210 and 220, the second portion 260 of the fourth chassis 240 may be arranged to be overlapped with the first portion 250 in the plan view. In this case, the protruding coupling members 254 of the first portion 250 of the fourth chassis 240 may be aligned and arranged to overlap the second holes 262 in the second portion 260. The PCB 150 may be disposed between the first portion 250 and the second portion 260.

In order to fix the second portion 260 to the first portion 250, second fastening members 510 may be further provided. The second fastening members 510 may be male threaded member having a screw thread at the external side thereof. The second fastening members 510 may be fastened to the protruding coupling members 254 through the second holes 262.

In the exemplary embodiment of the multi-display device according to the invention, a first side, a second side and a third side of one display device correspond to portions adjacent to another display device, and the fixing member such as a double-sided tape is used to fix the one display panel and the chassis to each other at the first to third sides. At the first to third sides of the one display panel, the chassis is fixed to the one display panel using the fixing member such as the double-sided tape rather than using a fastening member having a relatively large dimension such as a screw, so that the size of the bezel of the one display panel can be minimized.

In the exemplary embodiment of the multi-display device according to the invention, the chassis covers the first to fourth sides of the display panel and covers the front edges adjacent to the first to fourth sides of the display panel, but the invention is not limited thereto. In an alternative exemplary embodiment, the chassis may cover the first to fourth sides of the display panel and cover rear edges adjacent to the first to fourth sides of the display panel. Accordingly, the fixing member such as the double-sided adhesive tapes may be between the rear edges of the display panel and the chassis.

Next, another exemplary embodiment of a multi-display device according to the invention will be described in further detail.

The exemplary embodiment of the multi-display device in FIGS. 12-15 is similar to the previous exemplary embodiment of the multi-display device. Since the same reference numerals will be used to refer to same or like parts as those described in the previous exemplary embodiment, any further repetitive explanation concerning the above elements will be omitted.

The exemplary embodiment of the multi-display device according to the invention includes a plurality of display devices connected with each other to form the multi-display device, and each display device includes a display panel, and a chassis which surrounds the display panel.

First, referring to FIG. 12 and FIG. 13, an exemplary embodiment of a first chassis and a second chassis of the multi-display device will be described. Since the second chassis is symmetrical to the first chassis, no further description will be provided.

Figure 12:
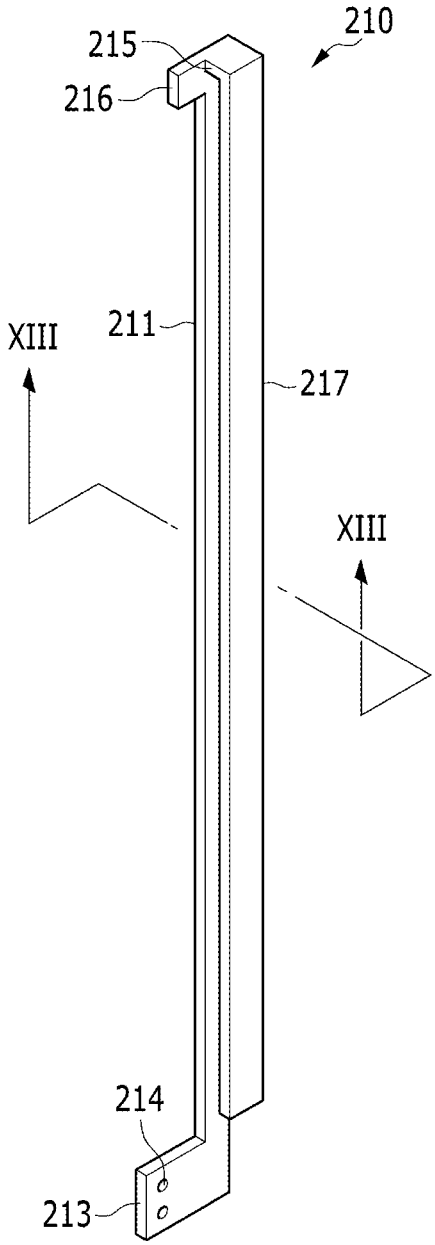
FIG. 12 is a perspective view of another exemplary embodiment of a first chassis of the multi-display device according to the invention.
Figure 13:
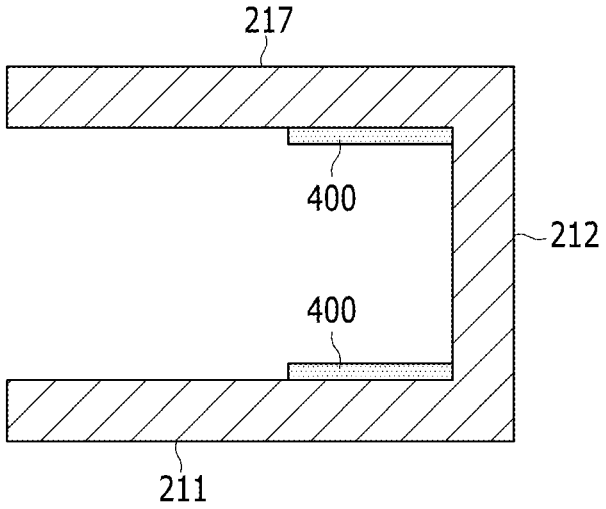
FIG. 13 shows a cross-sectional view of the first chassis taken along line XIII-XIII of FIG. 12 and a fixing member attached thereto according to the invention.

FIG. 12 is a perspective view of an exemplary embodiment of the first chassis of the multi-display device according to the invention, and FIG. 13 is a cross-sectional view of the first chassis taken along line XIII-XIII of FIG. 12 and a fixing member attached thereto according to the invention.

A first chassis 210 includes a first front portion 211 and a first side portion 212, and may further include first to third protruding portions 213, 215, and 216.

In addition, the first chassis 210 may further include a first rear portion 217 connected with the first side portion 212, such that the first chassis 210 may be a single, unitary, indivisible member. The first rear portion 217 is connected with the first side portion 212 and bent about 90 degrees with respect to the first side portion 212. A length of the first rear portion 217 may correspond to the length of the first side 110 of the display panel 100. A fixing member 400 such as a double-sided adhesive tape 400 is attached to an inner side of the first rear portion 217. Thus, the first rear portion 217 of the first chassis 210 is arranged to face, overlap and cover rear edges adjacent to the first side 110 of the display panel 100, and the first chassis 210 can be fixed to the first side 110 of the display 100 using the double-sided adhesive tape 400. When display devices 300 are disposed adjacent to each other, the double-sided adhesive tape 400 at the inner side of the first rear portion 217 is at a boundary between the adjacent display devices 300. The fixing member 400 is completely between the first rear portion 217 of the first chassis 210 and the rear side of the display panel 100.

FIG. 13 illustrates that the double-sided adhesive tape 400 is attached to both of the inner sides of the first front portion 211 and the first rear portion 217, but the invention is not limited thereto. That is, the double-sided adhesive tape 400 may be attached only to the inner side of the first rear portion 217.

Since a rear edge of the display panel 100 is covered by the first rear portion 217 of the first chassis 210, a width of the first rear portion 217 may determine the size of the bezel if the display panel 100 is a transparent display device. The width may be taken perpendicular to the first side 110 of the display panel 100. Thus, the size of the bezel can be reduced as the width of the first rear portion 217 is reduced. However, when the width of the first rear portion 217 is too small, adherence between the first chassis 210 and the display panel 100 is weakened, and therefore the first rear portion 217 has a sufficient width to properly fix the first chassis 210 to the display panel 100.

An exemplary embodiment of a third chassis of the multi-display device according to the invention will be described with reference to FIG. 14 and FIG. 15.

Figure 14:
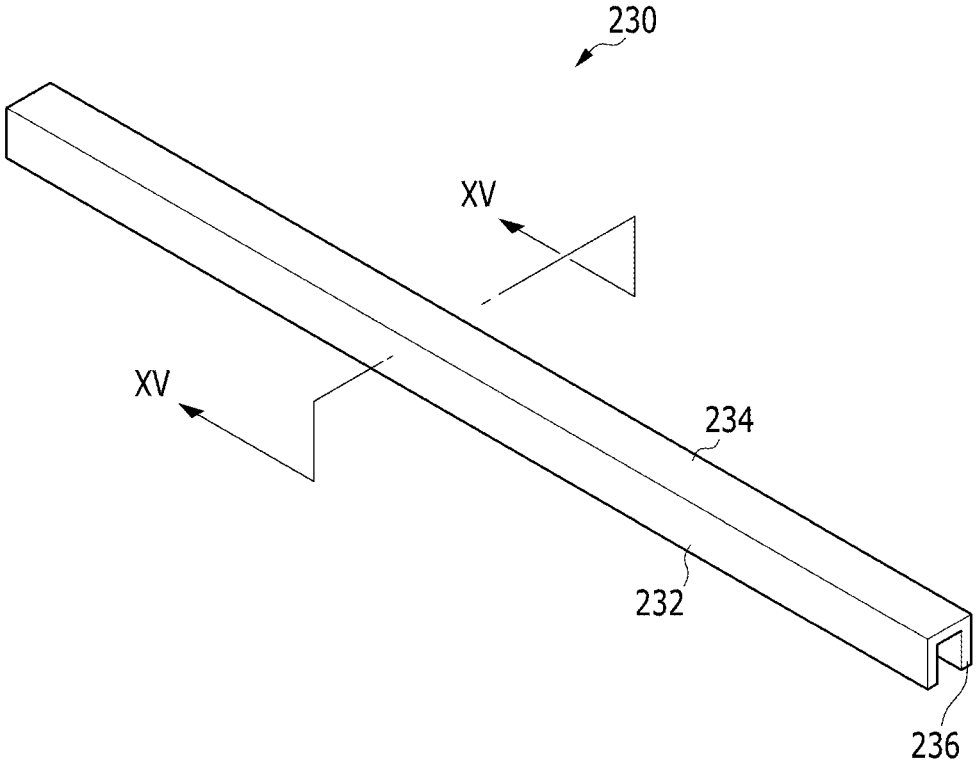
FIG. 14 is a perspective view of another exemplary embodiment of a third chassis of the multi-display device according to the invention.
Figure 15:
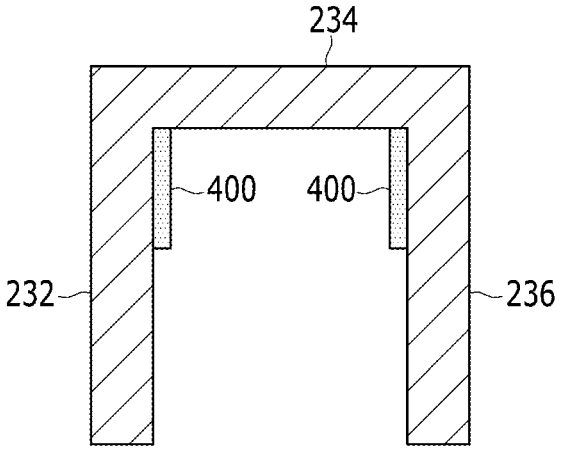
FIG. 15 is a cross-sectional view of the third chassis along line XV-XV of FIG. 14 and a fixing member attached thereto according to the invention.

FIG. 14 is a perspective view of an exemplary embodiment of the third chassis of the multi-display device according to the invention, and FIG. 15 is a cross-sectional view of the third chassis taken along line XV-XV of FIG. 14 and a double-sided adhesive tape attached thereto according to the invention.

A third chassis 230 includes a second front portion 232 and a second side portion 234.

In addition, the third chassis 230 may further include a second rear portion 236 connected with the second side portion 234 such that the second chassis 230 may be a single, unitary, indivisible member. The second rear portion 236 may have a length corresponding to the third side 130 of the display panel 100 or may be shorter than the third side 130. The fixing member such as the double-sided adhesive tape 400 is attached to the inner side of the second rear portion 236. Thus, the second rear portion 236 of the third chassis 230 is arranged to face, overlap and cover an edge of the rear side adjacent to the third side 130, and the third chassis 230 may be fixed to the third side 130 of the display panel 100 using the double-sided adhesive tape 400. When display devices 300 are disposed adjacent to each other, the double-sided adhesive tape 400 at the inner side of the second rear portion 236 is at a boundary between the adjacent display devices 300. The fixing member 400 is completely between the second rear portion 236 of the third chassis 230 and the rear side of the display panel 100.

FIG. 15 illustrates that the double-sided adhesive tape 400 is attached to both of the inner sides of the second front portion 232 and the second rear portion 236, but the invention is not limited thereto. That is, the double-sided adhesive tape 400 may be attached only to the inner side of the second rear portion 236.

Since a rear edge of the display panel 100 is covered by the second rear portion 236 of the third chassis 230, a width of the second rear portion 236 may determine the size of the bezel. The width may be taken perpendicular to the third side 130 of the display panel 100. Thus, the size of the bezel can be reduced as the width of the second rear portion 236 is reduced. However, when the width of the second rear portion 236 is too small, adherence between the third chassis 230 and the display panel 100 is weakened, so the second rear portion 236 has a sufficient width to properly fix the third chassis 230 to the display panel 100.

When the third chassis 230 is fixed to the display panel 100, the second rear portion 236 may be partially overlapped with the first rear portion 217 of the first chassis 210.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A multi-display device comprising: a plurality of display devices which are arranged adjacent to each other, wherein a display device of the plurality of display devices comprises: a display panel including a front side, a rear side, first and second sides which face each other, and third and fourth sides which face each other; a first chassis which is fixed to the first side; a second chassis which is fixed to the second side; a third chassis which is fixed to the third side; a fourth chassis which is fixed to the fourth side; a fixing member between one or more of the first to fourth chassis, and the display panel; and a printed circuit board which is attached to the fourth side of the display panel, wherein the printed circuit board transmits signals which drive the display panel, the fixing member fixes the one or more of the first to fourth chassis to the respective side of the display panel, and is at a boundary between adjacent display devices of the plurality of display devices, and the fourth side of the display panel is not adjacent to an adjacent display device of the plurality of display devices; wherein the fourth chassis comprises: a first portion which is fixed to the first chassis and the second chassis, and a second portion which overlaps the first portion and is fixed to the first portion, and wherein the first portion further comprises: a second coupling member at opposing ends of the first portion, wherein the second coupling member penetrates the first portion and has a screw thread therein.

2. The multi-display device of claim 1, wherein the first chassis and the second chassis are symmetrical.

3. The multi-display device of claim 1, further comprising a first connecting member which overlaps the first chassis and the fourth chassis, wherein the first connecting member comprises a first hole which penetrates the first connecting member.

4. The multi-display device of claim 1, wherein the first portion further comprises a protruding coupling member which protrudes from the first portion and toward the second portion, and has a screw thread therein.

5. The multi-display device of claim 1, wherein the display device is a transparent display device.

6. The multi-display device of claim 1, wherein the fixing member is a double-side adhesive member.

7. The multi-display device of claim 2, wherein the first chassis comprises:

a first front portion which overlaps an edge of the front side of the display panel adjacent to the first side of the display panel, and a first side portion which is connected with the first front portion and overlaps the first side of the display panel.

8. The multi-display device of claim 1, further comprising a plurality of first fastening members which connect the first connecting member and the first chassis to each other, and connect the first connecting member and the fourth chassis to each other, wherein the first chassis further comprises: a first protruding portion which protrudes from a first end of the first front portion, and a first coupling member which penetrates the first protruding portion and has a screw thread therein, and the first fastening member is in the first coupling member of the first chassis and the second coupling member of the fourth chassis, and extends through the first hole of the first connecting member.

9. The multi-display device of claim 4, wherein the second portion further comprises a second hole which penetrates the second portion.

10. The multi-display device of claim 7, wherein the fixing member is between the first front portion and the display panel.

11. The multi-display device of claim 7, wherein the third chassis comprises:

a second front portion which overlaps an edge of the front side of the display panel adjacent to the third side of the display panel, and a second side portion which is connected with the second front portion and overlaps the third side of the display panel.

12. The multi-display device of claim 9, further comprising a second fastening member which is in the protruding coupling member of the first portion of the fourth chassis, and extends through the second hole of the second portion of the fourth chassis.

13. The multi-display device of claim 10, wherein the first chassis further comprises:

a first protruding portion which protrudes from a first end of the first front portion, and a first coupling member which penetrates the first protruding portion and has a screw thread therein.

14. The multi-display device of claim 10, wherein the first chassis further comprises:

a first rear portion which is connected with the first side portion and overlaps an edge of the rear side of the display panel adjacent to the first side of the display panel, wherein the fixing member is between the first rear portion and the display panel.

15. The multi-display device of claim 11, wherein the fixing member is between the second front portion and the display panel.

16. The multi-display device of claim 11, wherein the third chassis further comprises:

a second rear portion which is connected with the second side portion and overlaps an edge of the rear side of the display panel adjacent to the third side of the display panel, wherein the fixing member is between the second rear portion and the display panel.

17. The multi-display device of claim 13, wherein the first chassis further comprises:

a second protruding portion which is connected with the first front portion and the first side portion at a second end of the first front portion, and overlaps a portion of the third side of the display panel which is adjacent to the first side of the display panel.

18. The multi-display device of claim 17, wherein the first chassis further comprises:

a third protruding portion which protrudes in a same direction as the first protruding portion and from the second end of the first front portion.

* * * * *